US005551469A

United States Patent [19]

Woerheide

[11] Patent Number: 5,551,469

[45] Date of Patent: Sep. 3, 1996

[54] METHOD AND APPARATUS TO MAINTAIN INDEX STEAM QUALITY IN BOTH OUTLET LEGS OF A HORIZONTAL IMPACT T JUNCTION

[75] Inventor: Edward A. Woerheide, Houston, Tex.

[73] Assignee: Texaco Inc., White Plains, N.Y.

[21] Appl. No.: 393,786

[22] Filed: Feb. 24, 1995

[51] Int. Cl.[6] ..... F16L 41/02

[52] U.S. Cl. ..... 137/8; 137/561 A; 137/599

[58] Field of Search ..... 137/8, 561 A, 137/599

[56] References Cited

U.S. PATENT DOCUMENTS 5,218,985 6/1993 Berger et al. ..... 137/8

5,250,104 10/1993 Berger et al. ..... 95/254

5,415,195 5/1995 Stoy et al. ..... 137/8

*Primary Examiner*—Gerald A. Michalsky

*Attorney, Agent, or Firm*—Kenneth R. Priem; Cynthia L. Hunter; Richard A. Morgan

[57] ABSTRACT

Steam quality is maintained substantially equal in the two outlet legs of a horizontal impact T junction, as the mass extraction ratio in each leg varies, by orifice plates fixed in each outlet leg and bypass pipes connected between a point upstream of the junction and down stream of the respective orifice plates.

3 Claims, 1 Drawing Sheet

METHOD AND APPARATUS TO MAINTAIN INDEX STEAM QUALITY IN BOTH OUTLET LEGS OF A HORIZONTAL IMPACT T JUNCTION

BACKGROUND OF THE INVENTION

FIELD OF THE INVENTION

The present invention relates to a device for use in connection with two-phase fluid flow to maintain the inlet steam quality in the outlet legs of a horizontal impact T junction as the vapor mass extraction ratio varies in each outlet leg.

CROSS REFERENCE TO RELATED PATENTS

The present invention represents an improvement in the inventions described in U.S. Pat. Nos. 5,218,985 and 5,250,104, the disclosures of which are incorporated herein by reference.

THE PRIOR ART

There is a need for a simple method and apparatus for wet vapor distribution systems to control fluid quality through a pipe junction, particularly at impact T-junctions. Such an apparatus, if simplified, would be very useful in a steam distribution system to control saturated or wet steam quality and thereby the amount of available heat since there is more heat in each pound of steam vapor than a pound of saturated liquid.

Steam quality, or wet vapor quality, is the proportion of a fluid's total liquid and vapor mass that is vapor. Subscript 1 refers to the T inlet, 2 and 3 to the two T outlets, $$X_3 = \frac{M_{g3}}{M_{f3} + M_{g3}}$$

f to liquid and g to vapor.

$X_1$=Inlet Quality $X_3$=Outlet 3 Quality $X_2$=Outlet 2 Quality $M_{g1}$=Inlet Vapor Mass Rate $M_{f1}$=Inlet Liquid Mass Rate The vapor extraction ratio is defined as the proportion of inlet vapor mass that flows into each junction outlet.

$$F_{g3} = T \text{ Outlet 3 Vapor Extraction Ratio}$$

$$F_{g3} = \frac{M_{g3}}{M_{g3} + M_{g2}} = \frac{M_{g3}}{M_{g1}}$$

Where, $F_{g3}$=T outlet 3 Vapor Extraction Ratio $Mg_1$=Inlet Vapor Mass Rate $Mg_2$=Outlet branch 2 mass rate of vapor phase $Mg_3$=Outlet branch 3 mass rate of vapor phase Generally, as high pressure wet vapor flows through a horizontal pipe, the vapor and liquid phases tend to separate with the heavier and slower liquid phase flowing along bottom portion of the horizontal pipe and the vapor phase flowing above the liquid surface at low vapor mass rates. As the vapor mass rate increases for a constant liquid mass rate, the liquid phase becomes more annular and adheres to the pipe walls while the lighter and faster vapor phase flows inside the annular liquid film on the pipe wall. The liquid flow has a symmetrical pattern about a vertical pipe centerline at either low or high vapor mass rate. This symmetrical liquid flow pattern allows nearly equal amounts of liquid to split and flow into each branch of a horizontal impact T junction although the vapor extraction ratio to each outlet is different. The result is the difference in outlet steam qualities, $X_3$–$X_2$, becomes greater as the vapor extraction ratio of one T outlet increases and the vapor extraction ratio in the other T outlet decreases.

"Phase splitting" is a term used to describe a change in fluid quality X as a two phase or gas and liquid mixture flows through a pipe junction, $X_1$–$X_3$. These pipe junctions can be impacts Ts, branch Ts, crosses, manifolds, etc. The liquid and vapor portions of a fluid do not split in relatively equal mass proportions except at impact T junctions when the vapor split is equal, a vapor extraction ratio of 0.5, and there is a symmetrical liquid flow pattern. An unequal vapor ratio normally occurs in steam distribution systems, such as those used for enhanced oil recovery. This results in unequal steam quality after each pipe junction and this stream quality difference increases as more pipe junctions are used in the distribution system.

It is important, as a matter of economic practicality, that a means be instituted to prevent unequal quality downstream of junctions and to maintain the same steam quality upstream and downstream of all pipe T junctions in the distribution system. Numerous studies investigating phase splitting have been conducted and various devices to equalize or control phase splitting have been tried. However, only a few of these ideas have been implemented in the design of new steam distribution systems and none have become standard practice throughout the industry. Still feather of these methods are commonly encountered as "fixes" to minimize or control phase splitting, in distribution systems which were built before phase splitting was widely understood. The method disclosed here meets the criteria required of a "fix" in that it requires no operator action, creates minimal pressure drop, and is both inexpensive and effective.

An example of where the present invention would be particularly useful is secondary recovery of hydrocarbons from marginal fields or heavy oil reserves that require a degree of stimulation to achieve satisfactory flow of crude petroleum. In such operations steam is distributed to a patterned array of injection wells to heat the formation being treated and drive the hydrocarbons towards a production well. The steam quality at each injection well will directly affect the rate of formation heatup and thus the efficiency of the recovery operation. The vapor phase of the steam will have the most heat and provide the greatest oil recovery from the formation. Thus it is desirable to have steam of uniform quality injected into each pattern of the formation.

SUMMARY OF THE INVENTION

The present invention substantially eliminates unequal phase splitting at piping junctions and automatically compensates for changes in vapor extraction ratio. It also allows for control of phase splitting, when unequal steam quality splits are desired by using a liquid flow restriction device, and introduces very little additional pressure drop. The present invention provides means to facilitate separation of the liquid and vapor phases and then, by directing the liquid phase through a bypass around the piping junction, recombines the liquid phase with the vapor phase downstream of the piping junction in proportion to the vapor extraction ratio at the junction.

BRIEF DESCRIPTION OF THE DRAWINGS

The present invention will now be described, by way of example, with reference to the accompanying drawings in which.

DESCRIPTION OF A PREFERRED EMBODIMENT OF THE INVENTION

Figure 1:
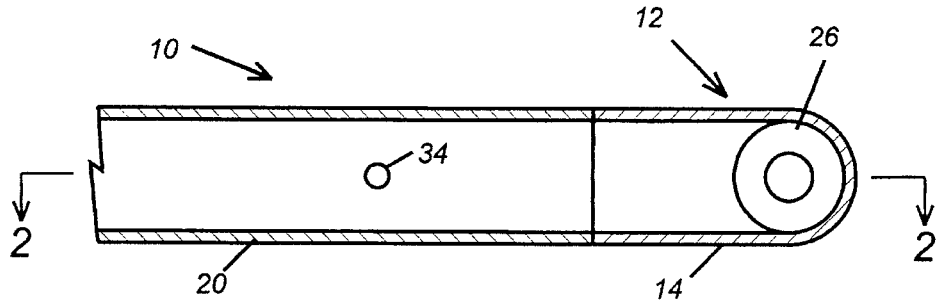
FIG. 1 is a vertical section, taken along line 1—1 of FIG. 2, through the device according to the present invention.
Figure 2:
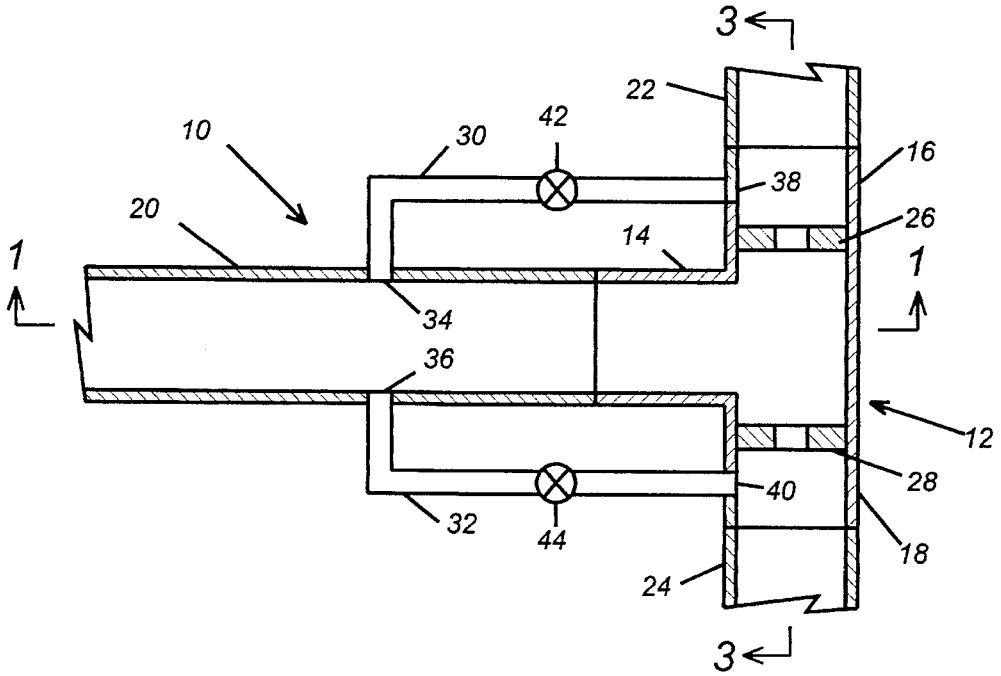
FIG. 2 is a horizontal section through the present invention taken along line 2—2 of FIG. 1.
Figure 3:
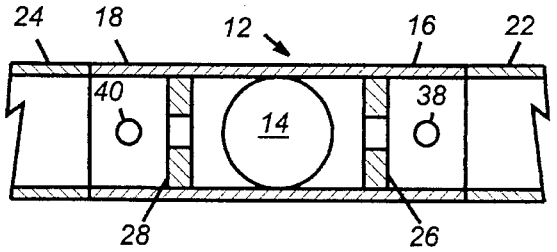
FIG. 3 is a detailed vertical section taken along line 3—3 of FIG. 2.

The subject device 10 is associated with a horizontal impact T junction 12 having an input branch 14 and two outlet legs 16, 18. The input branch 14 is connected to an input pipe 20 while the outlet legs are connected to respective outlet pipes 22, 24. Orifice plates 26, 28 are installed in the outlet legs and pipes or tubing 30, 32 are connected between taps 34, 36 in the inlet branch and taps 38, 40 in the outlet legs.

The subject invention 10 is a device for use with two-phase fluid flow to reduce the steam quality difference in the two outlet legs of a horizontal impact T junction as the mass extraction ratio in each leg varies from about 20% to about 80% of the total inlet mass rate. Orifice plates 26 and 28 are installed on each of the outlet legs 16 and 18. Tubing or pipe is connected from taps 34 and 36 at the inlet or branch line 14 to respective taps 38 and 40 downstream of each orifice plate 26 and 28 in the outlet legs 16 and 18. The two taps 34 and 36 in the inlet branch are to be installed symmetrically to a vertical center line, at or below the horizontal plane along line 2–2 of FIG. 1. The connection from each outlet leg 16 and 18 to the taps in the inlet line 30 and 32 are intended to perform two functions. One function is to extract liquid phase flow from the two phase fluid is input branch 14 in the same proportion as the vapor mass rate in each outlet leg 16 and 18. The second function is to influence the flow pattern of the extracted liquid portion of the two phase flow toward the side of the junction which has the most vapor exiting an outlet leg 16 and 18. The intent is to influence the liquid portion of the two phase flow, similar to the method used in pneumatic floppy control valves, for single phase flow. It is also possible to have unequal steam quality splits between the outlet legs by providing known liquid flow control means, such as valves 42, 44, in respective pipes 30, 32.

The orifice Beta ratio and tubing or pipe size for various nominal pipe diameters has to be determined using laboratory data as basis for modeling.

The present invention substantially eliminates the effect of phase splitting at impact T piping junctions with minimal pressure loss to the steam.

The present invention may be subject to many modifications and changes, which will be apparent to one skilled in the art, without departing from the spirit or essential characteristics thereof. The present embodiment is therefore to be considered in all respects as illustrative and not restrictive of the scope of the invention as defined by the appended claims.

I claim:

1. A method to control steam quality in both outlet arms of a horizontal impact T pipe junction having an input leg and two outlet arms, comprising the steps of:

providing flow constriction means in both outlet arms of said junction at the same distance from the center of said input leg:

providing two, equal length liquid and vapor bypass lines in a plane between horizontally and vertically aligned points in said input leg upstream of said junction in said input leg and a pair of symmetrical horizontally and vertically aligned points downstream of said respective flow constriction means in said outlet arms, the dimensions of said liquid and vapor bypass being selected such that the liquid phase of the two phase steam is extracted from said input leg in the same proportion as the vapor mass flow rate in each of said outlet arms respectfully and each of said equal length liquid and vapor bypass lines being provided with a liquid flow control valve along its length for controlling the liquid mass flow rate therethrough: and flowing wet steam into said junction through said input leg and through said liquid and vapor bypass lines to a point on each junction outlet arm downstream of said flow constrictions due to the differential pressure created by the vapor phase as it flows past said flow constrictions, and varying said liquid flow control valves to control the liquid flow rate in each of said liquid and vapor bypass lines resulting in controlling to a predetermined value the steam quality in each of said outlet arms.

2. An apparatus for controlling the quality of wet steam in each of two outlet arms of a horizontal impact T-pipe junction having an input leg and two outlet arms comprising:

two equal length liquid and vapor bypass conduits connected in a horizontal phase between said input leg and each of said outlet arms, said conduits being in the same single horizontal plane with each other and each being provided with a liquid flow control valve, the dimensions of said liquid and vapor bypass conduits being such that the liquid component of the two phase steam is extracted from said input leg in the same proportion as the vapor mass flow rate in each of said outlet arms respectively; and flow constriction means in each output arm of said junction upstream of said liquid and vapor bypass conduits' entry point thereto, whereby said liquid and vapor phase of said wet steam are effectively controlled in proportion to the settings of said flow control valves upon exiting said junction.

3. The apparatus according to claim 2 wherein said constrictions are orifices.

* * * * *